United States Patent [19]

Kingston

[11] Patent Number: 4,564,086

[45] Date of Patent: Jan. 14, 1986

[54] TRANSPORT SEAT FOR CONVEYING DISABLED TRAVELLERS THROUGH A STAIRWELL OPENING OF A PASSENGER CARRYING VEHICLE

[76] Inventor: John C. Kingston, 261 Cooper St., Suite 1210, Ottawa, Ontario, Canada, K2P 0G3

[21] Appl. No.: 546,300

[22] Filed: Oct. 28, 1983

[30] Foreign Application Priority Data

May 4, 1983 [CA] Canada ..... 427379

[51] Int. Cl.[4] ..... B66B 9/08

[52] U.S. Cl. ..... 187/12; 182/37; 414/921

[58] Field of Search ..... 414/539, 540, 921; 187/10, 12, 24, 13, 14; 198/300; 244/137 P; 182/37, 103

[56] References Cited

U.S. PATENT DOCUMENTS

| | | | |
|---|---|---|---|
| 2,563,260 | 8/1951 | Miller | 187/12 |
| 2,619,195 | 11/1952 | Scott | 187/12 |
| 2,824,623 | 2/1958 | Nord et al. | 187/12 |
| 2,856,027 | 10/1958 | Schryver | 187/12 |
| 2,985,257 | 5/1961 | Jackson | 187/12 |
| 3,168,937 | 2/1965 | Redford et al. | 187/10 X |
| 3,180,503 | 4/1965 | Shaw | 414/540 |
| 3,500,963 | 3/1970 | Beutler | 187/12 |
| 3,515,294 | 6/1970 | Southward et al. | 414/921 X |
| 3,662,859 | 5/1972 | Flinchbaugh | 187/12 |
| 3,749,201 | 7/1973 | Clarke | 187/9 R |
| 3,833,092 | 9/1974 | Flinchbaugh | 187/12 |
| 3,891,062 | 6/1975 | Geneste | 187/10 |
| 3,937,301 | 2/1976 | Bertail | 187/9 R X |
| 4,043,427 | 8/1977 | Ackerman | 187/12 |
| 4,050,546 | 9/1977 | Wilson, Jr. | 187/12 |
| 4,174,023 | 11/1979 | Dooley | 187/12 |
| 4,183,423 | 1/1980 | Lewis | 187/10 X |
| 4,306,634 | 12/1981 | Sangster | 414/921 X |
| 4,427,094 | 1/1984 | Winkelblech | 187/12 X |

*Primary Examiner*—Robert J. Spar
*Assistant Examiner*—Stuart J. Millman
*Attorney, Agent, or Firm*—Frishauf, Holtz, Goodman & Woodward

[57] ABSTRACT

A transport seat for conveying disabled travellers through a stairwell opening of a passenger carrying vehicle is disclosed. An elongate boom section is pivotally connected to a support base located exterior of the vehicle and is intended to extend over the stairwell of the vehicle. The boom section at its vehicle interior end is supported from the floor or a stair tread of the vehicle. A seat is carried on the boom section and is reciprocatable therealong. A traveller on the seat, during transport, faces outwardly of the vehicle towards the support base. The seat, however, is made rotatable so that a traveller on the seat, after being transported into the interior of the vehicle, can be rotated in a horizontal plane in order to face the vehicle floor and leave the seat and conversely, can first occupy the seat and then be rotated to face the support base before being transported from the interior of the vehicle. Because the vertical angle of the boom may vary, the seat carried on it is made adjustable so that it remains in a substantially horizontal plane during use. The support base can be located at a fixed position, or optionally, roller mounted for portability. The device is principally intended for use with passenger coaches but can also be employed when transporting disabled travellers to and from trains and aircraft. No structural or mounting alterations to the passenger carrying vehicle are required.

15 Claims, 4 Drawing Figures

TRANSPORT SEAT FOR CONVEYING DISABLED TRAVELLERS THROUGH A STAIRWELL OPENING OF A PASSENGER CARRYING VEHICLE

BACKGROUND

Various conveyance devices for loading and unloading disabled travellers onto and from passenger carrying vehicles are known. The stairwells to vehicles, particularly buses or motor coaches, are relatively narrow and not conducive to the conveyance device being carried on the vehicle itself. Moreover, on-board vehicle conveyance devices are relatively complex in construction, and in any event must be folded or otherwise stored away in order to permit the unhandicapped to embark and disembark through the vehicle's stairwell in a conventional manner. There has thus been a need for a conveyance for loading and unloading disabled travellers which is relatively inexpensive, capable of transporting a disabled traveller through narrow confines such as a stairwell of a conventional bus and finally, from the disabled traveller's perception, appears stable and secure.

SUMMARY OF THE INVENTION

The novel conveyance device for loading and unloading disabled travellers on a seat through a stairwell of a passenger carrying vehicle comprises a support base for locating on a loading surface or platform exterior of the vehicle. An elongate boom section is, at one end, pivotally connected to the support base and its other end is connected to a boom-head; the boom section and boom-head being intended to extend interiorally of the vehicle over the vehicle stairwell. The rotatable and movable seat is carried on the boom section on its side opposite the stairwell. Support means is connected to the boom-head for supporting the boom section from at least one of a floor of the vehicle and a stair tread of the vehicle stairwell when the boom section is in an operationally disposed condition above the stairwell. Carriage means is employed for reciprocatingly moving the seat along the boom section between its ends. The seat itself includes angle adjustment means in order to maintain the seat in a substantially horizontal plane when the boom section is in its operationally disposed condition above the stairwell.

It is apparent that the novel conveyance device is not intended to be fixed to the vehicle and thus no structural or mounting alterations to the vehicle are required. However, the device, if required, can be carried elsewhere in the vehicle, such as in a luggage bay of a bus.

In accordance with my invention, where the conveyance device is to remain stationary with the intention that the stairwell of the vehicle be stopped and positioned directly opposite it, the support base may in fact be an integral part of the loading surface. In a preferred form of construction, however, the support base is roller mounted for easy transport of the conveyance device over a loading surface to and from an open stairwell. Employing rollers, once the support base or "dolly" is placed in position with the boom section extending over the stairwell, brake means are applied so as to effectively hold the "dolly" in a fixed position. Suitable rollers or brakable casters are manufactured by Colson Caster Corporation of Jonesboro, Ark. under model number 5210X1. Optionally, weight carried by rollers or casters can be transferred to the loading surface through extention/retraction means, known as "floor locks" in the trade, so that movement of the support base is effectively arrested by frictional engagement between the "floor locks" and the loading surface.

The seat upon which the disabled traveller is transported along the boom section is made rotatable through any desired arc in a horizontal plane. In order to be loaded onto the bus the traveller occupies the seat adjacent the support base exterior of the bus and is transported, with his or her back towards the stairwell, up to a position adjacent the boom-head interior of the bus. The traveller is then rotated to a point where it is possible to most conveniently get out of the seat onto a floor of the bus. Conversely, when being unloaded the traveller occupies the seat adjacent the boom-head interior of the bus, the seat is then rotated to face the support base exterior of the bus and the traveller is transported down the boom section to a position adjacent the loading surface where he can get out of the seat.

Depending on the nature of the traveller's disability, and advantageously, the seat can also include leg support and clearance means for the traveller's legs. This assists in maintaining the legs clear from contact with the elongate boom section both during transport and upon rotation of the seat interior of the vehicle.

In one preferred form of construction the boom section comprises at least two parallel and spaced apart slide-rails. A crosshead, which forms part of the carriage means, is carried on the slide-rails for reciprocatable movement therealong. The motive force applied to the carriage means for movement of the crosshead along the slide-rails can involve, for example, electric, hydraulic or pneumatic drive means. I however prefer to use an elongate feed-screw which extends parallel to the slide-rails and which is rotatably supported at one end by the boom-head and which is rotatably supported at its other end by a transverse member adjacent to the pivotal connection of the boom section to the support base. In this arrangement a threaded, feed-screw attachment means is located on the crosshead, which in turn, as part of the carriage means, carries the seat. Reciprocatable movement of the crosshead and seat is facilitated by rotation of the feed-screw.

When employing a feed-screw arrangement as above described the motive or prime mover means is preferably an electric motor that includes interconnecting means such as gears or the like connecting the prime mover to the feed-screw so as to cause rotation of same in either direction as desired.

Although any suitable seat angle adjustment means can be employed, I prefer to position it between the crosshead and the seat. If desired, the seat angle adjustment means may take the form of a hinged section which forms part of the carriage means and which is pivotal along an axis perpendicular to the axis of the elongate boom section. For security purposes, locking means can also be provided for holding the hinged section in any desired position, thereby ensuring that the seat can be adjusted to remain in any substantially horizontal position during use.

In accordance with yet another preferred embodiment of my invention, the boom support means is pivotally connected to the boom-head so as to depend downwardly therefrom. If desired, this pivotal connection can be locked in order to impart further rigidity to the device when in its operationally disposed condition by fixing a selected angle between the support means and boom section.

The support means which depends downwardly from the boom-head is intended to frictionally contact at least one of the vehicle floor or stair tread of the vehicle's stairwell. In order to contact both simultaneously, additional safety leg means can be suspended from support means so as to facilitate floor and stair tread contact.

In applications where the support base is made portable, alignment of the support base relative to the stairwell of a vehicle can be greatly facilitated by employing adjustable bumpers on the support base, which are intended to abut the lowermost tread or step of the stairwell, when the device is in its operationally disposed condition.

BRIEF DESCRIPTION OF THE DRAWINGS

In the accompanying drawings which illustrate one working embodiment of my invention.

DETAILED DESCRIPTION OF THE DRAWINGS

Figure 1:
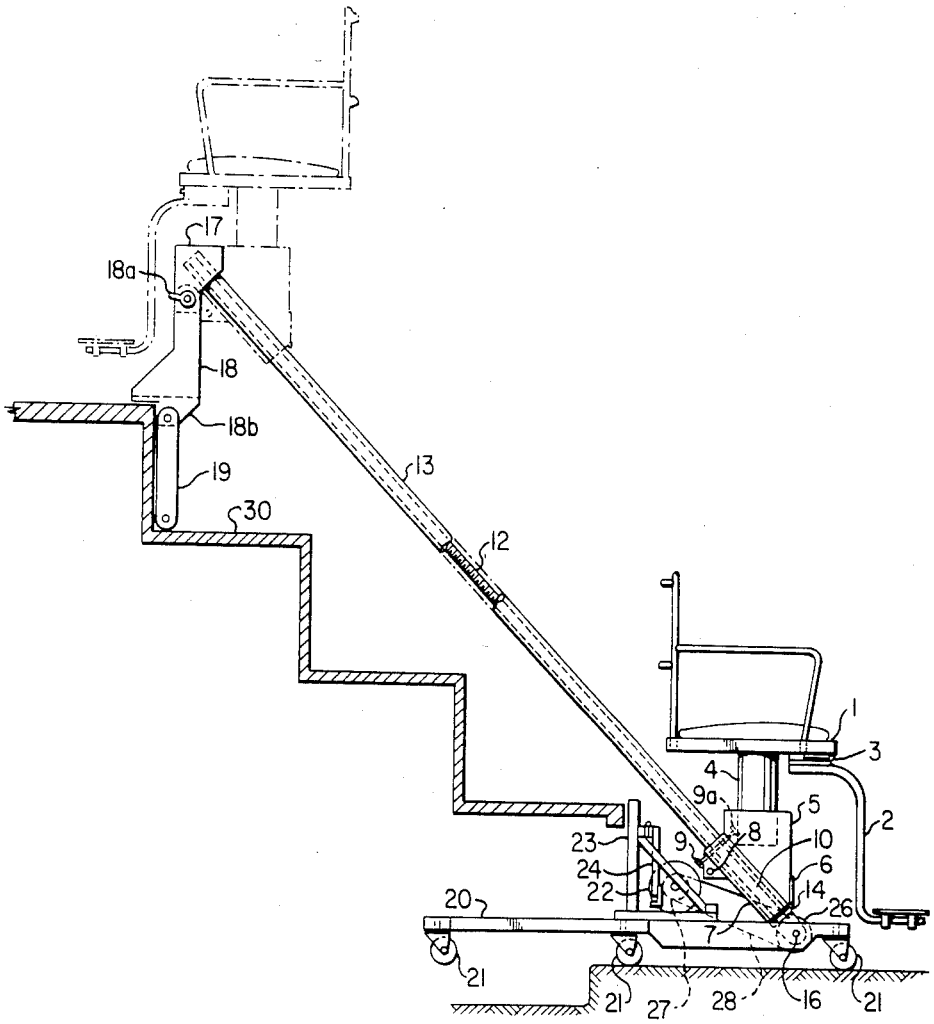
FIG. 1 is a side view of a stairwell entrance to a typical bus showing the conveyance device relative thereto when in its operationally disposed condition for loading and unloading disabled travellers.

Referring in detail to the drawings of this invention, FIG. 1 depicts a transport seat means for conveying disabled travellers between a bus depot loading platform or surface and the interior of a bus. It consists of a chair at 1 with arms, back, cushion and legs supports at 2, which is connected to a carriage means made up of rotation piece at 4, hinged, seat angle adjustment means at 5, hinge at 6 and a crosshead at 7. Leg support and clearance means indicated at 2 are attached to the under side of the seat indicated at 1 by hinges indicated 3. Said hinges allow the leg support means to turn upward when impacted against the boom-head if the operator of the device inadvertently starts to lower the seat away from its topmost position on the boom section before the seat has been rotated to face the support base.

The crosshead indicated at 7 is fitted with locking pin 8 which can be engaged by support arm 24 so that the boom can be held in an elevated position and have a stable posture when the device is at rest on the passenger loading surface. The crosshead is also fitted with set-screw 9 which, when connected to lock-nut **9*a* in the seat angle adjustment means, can be adjusted so as to keep the seat locked in a stable and level condition as elevation differences between loading surfaces and bus floor vary. A threaded, feed-screw attachment means indicated at 10 is installed in the cross-head and accommodates feed-screw indicated at 12. Holes at 11 through the crosshead at its outer ends (see FIG. 2) accommodate slide rails indicated at 13**.

The lower ends of the slide-rails 13 terminate in transverse member 14 which itself is fitted with a bearing to support the lower end of feed-screw 12.

The upper ends of slide-rails 13 terminate in boom-head 17 which itself is fitted with a bearing to support the upper end of feed-screw 12. Support means indicated at 18 are adjustably attached to boom-head 17 so that regardless of the vertical angle made by the boom section the support legs can be adjusted and locked in a vertical position by locking nut **18*a***.

Free swinging safety legs indicated at 19 are suspended from the heel portion **18*b* of support means 18 so that if the support means inadvertently slip off the bus floor the weight that said support means carry is immediately transferred through the safety legs to a stair tread indicated at 30**.

Shaft 16 pivotally connects the boom section to the support base (dolly) indicated at 20, which is mounted on casters indicated at 21, some of said casters being brakable. Dolly 20 supports electric motor 22 to which drive sprocket wheel 27 is fitted, driven sprocket wheel being indicated at 26. Said dolly also includes an adjustable stop bumper 23 to which support arm 24 is connected.

Figure 2:
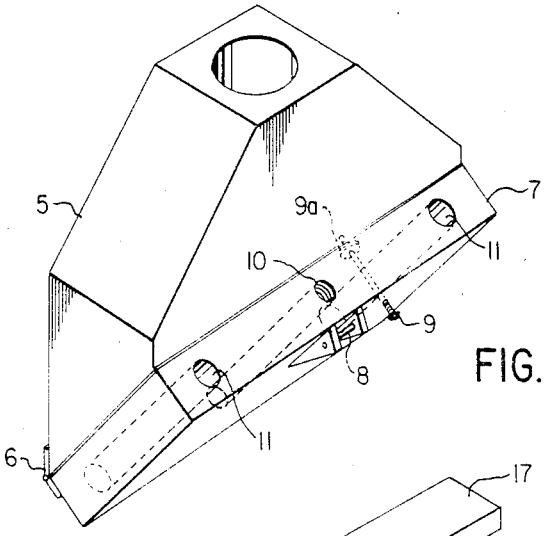
FIG. 2 is an isometric view of the crosshead and hinged section which enables the seat to be maintained in a substantially horizontal plane.

In FIG. 2 hinged, seat angle adjustment means indicated at 5 is mounted on and attached to crosshead 7 by means of hinge indicated at 6 (also see FIG. 1). Slide-rails pass through slide-rail holes 11 in the crosshead and the feed-screw is threaded through the feed-screw attachment means indicated at 10. Lock pin 8, set-screw 9 and lock nut **9*a* are indicated here as well as in FIG. 1**.

Figure 3:
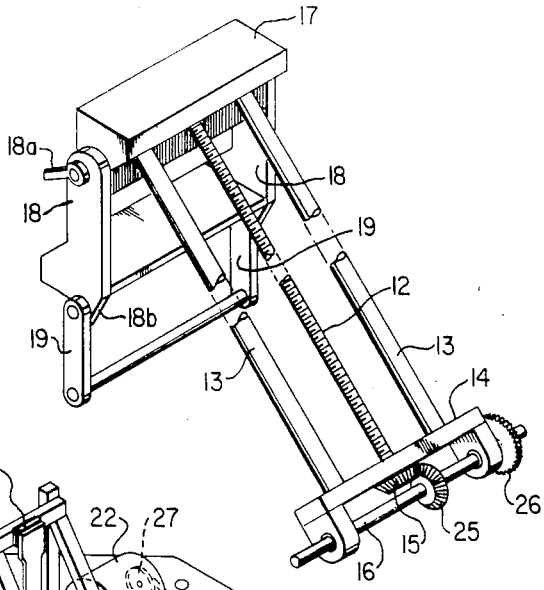
FIG. 3 is an isometric view of the support means, boom-head, boom section and transverse member and also illustrates the feed-screw and gear drive mechanism but without the carriage means, its crosshead or the seat being shown.

In FIG. 3 the parts of the device indicated are transverse member 14, slide-rails 13, feed-screw 12 along with its attached bevel gear 15, boom-head 17, support means 18, locking nut **18*a* and free swinging safety legs 19. Drive shaft 16 which pivotally connects the boom section to the dolly is also shown here with driven sprocket wheel 26 and bevel gear 25** attached.

Figure 4:
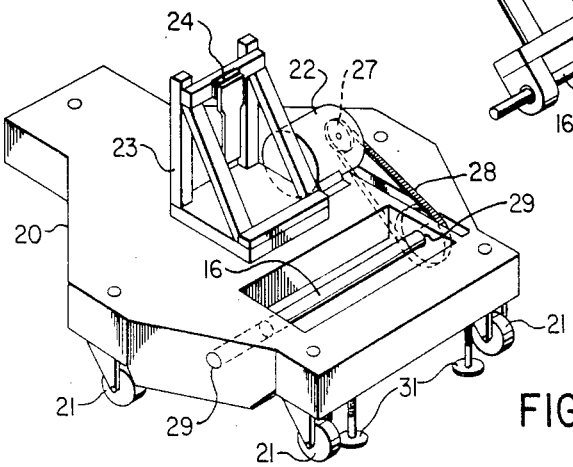
FIG. 4 is an isometric view of the caster mounted support base or "dolly" which also includes a support arm for supporting the boom section on the support base when the device is not in use.

In FIG. 4 dolly indicated at 20 rolls on 5 casters indicated at 21, some of said casters being brakable. Extention/retraction braking means, which add greater stability to the device when in its operationally disposed condition, are indicated at 31. The electric motor indicated at 22 along with its driving sprocket wheel 27 is installed on the dolly. Sprocket chain 28 drives sprocket wheel 26 which is fitted to drive shaft 16 which itself is held in bearings 29 in the dolly. Stop bumper 23 also indicated here impinges on the bottom step of the bus entrance so as to restrict further movement of the device towards the bus and aid in holding the device in proper operating position during use. Support arm 24 is shown here in its down position; when in the up position it latches onto locking pin 8 (see FIG. 2).

I claim:

1. A portable conveyance device having a seat moveably mounted thereon for loading and unloading disabled travellers through a stairwell of a passenger carrying vehicle, said device comprising:

(a) a support base carried by rollers for freely rolling the device from one location to another on a passenger loading platform, said support base being stable on said passenger loading platform when located exteriorly of said vehicle stairwell;

(b) an elongate boom section pivotally connected at one end thereof to said support base and projecting outwardly therebeyond terminating in an opposite free outer end having connected thereto a boom-head, said boom section projecting from said base in a direction toward the interior of said vehicle over said stairwell when in use with said support base on said loading platform;

(c) carriage means mounted on said boom section for reciprocal movement therealong in a direction from one end toward the other;

(d) means for reciprocally moving said carriage means along said boom section;

(e) a seat rotatably mounted on said carriage means and located on a side of said boom section opposite said stairwell;

(f) seat angle adjustment means for selectively setting the horizontal attitude of said seat on said carriage;

(g) support means connected to said opposite free outer end of said boom section for supporting the same from at least one of a floor of said vehicle and a stair tread of said stairwell during transport of a traveller through said stairwell by said device;

(h) means on said base selectively operable to prevent rolling movement of the same for maintaining said conveyance device in a fixed position on said loading platform during loading and unloading of travellers; and (i) locking means selectively operable preventing pivotal movement of said boom when said carriage means is at a position in the vicinity of said base whereby, when operated, the boom section is cantilevered from the base and wholly supported thereby.

2. The device as claimed in claim 1, wherein said seat is rotatable through at least 180 degrees in a horizontal plane from a first position facing said support base to a second position facing away therefrom.

3. The device as claimed in claim 2, wherein said seat further includes leg support and clearance means for clearing the legs of said travellers from contact with said elongate boom section.

4. The device as claimed in claim 1, wherein said roller mounted support base includes a plurality of casters and said rolling preventing means comprises brake means including extention/retraction means for elevating said casters above the top of said loading surface.

5. The device as claimed in claim 1, wherein said boom section comprises at least two parallel and spaced apart slide rails and said carriage means includes a crosshead reciprocally carried on said slide rail.

6. The device as claimed in claim 5, wherein said seat angle adjustment means is disposed between said crosshead and said seat.

7. The device as claimed in claim 6, wherein said seat angle adjustment means comprises a section connected by hinge means to said crosshead and pivotable along an axis perpendicular to said axis of said elongate boom section and means for locking said hinge in a fixed position.

8. The device as claimed in claim 5, wherein said boom section at said one end includes a transverse member which is pivotally connected to said support base, an elongate feed-screw extending parallel to said slide-rails and rotatably supported at its two ends by said transverse member and said boom-head, and said crosshead includes feed-screw attachment means for reciprocatable movement of said crosshead along said slide-rails upon rotation of said feed-screw.

9. The device as claimed in claim 8, wherein said conveyance device further includes a prime mover and means interconnecting said prime mover and said feed-screw for rotation of said feed-screw.

10. The device as claimed in claim 1, wherein said locking means selectively operable preventing pivotal movement of said boom includes a support arm on said base engageable with said carriage means.

11. The device as claimed in claim 1, wherein said support means is pivotally connected to said boom-head so as to depend downwardly therefrom.

12. The device as claimed in claim 1, wherein said support means at positions remote from said boom-head includes safety leg means for simultaneous engagement with said floor and a first step of said stairwell below said floor.

13. A conveyance device having a seat for loading and unloading disabled travellers through a stairwell of a passenger carrying vehicle, said device comprising:

(a) a roller mounted support base which is stable on a loading surface located exteriorly of said vehicle stairwell;

(b) an elongate boom section pivotally connected at one end thereof to said support base and projecting outwardly therebeyond terminating in an opposite free outer end having connected thereto a boom-head, said boom section projecting from said base in a direction toward the interior of said vehicle over said stairwell when said support base is on said loading surface;

(c) carriage means mounted on said boom section for reciprocal movement therealong in a direction from one end toward the other;

(d) means for reciprocally moving said carriage means along said boom section;

(e) a seat rotatably mounted on said carriage means and located on a side of said boom section opposite said stairwell;

(f) seat angle adjustment means for selectively setting the horizontal attitude of the seat on said carriage;

(g) support means pivotally connected to said opposite free outer end of said boom section and depending downwardly therefrom for supporting the same from at least one of a floor of said vehicle and a stair tread of said stairwell during transport of a traveller through said stairwell by said device and including locking means for lockingly attaching said support means to said boom at a selected angle when said boom section is in an operationally disposed condition; and (h) means on said base selectively operable to prevent rolling movement of the same for maintaining said conveyance device in a fixed position on said loading surface during loading and unloading of travellers.

14. A conveyance device as defined in claim 1 wherein said means for reciprocally moving said carriage means is power driven.

15. A conveyance device as defined in claim 14 wherein said power driven means includes an elongate feed screw.

* * * * *